US009387706B2

(12) United States Patent
Yamamoto et al.

(10) Patent No.: US 9,387,706 B2
(45) Date of Patent: Jul. 12, 2016

(54) THERMAL TRANSFER PRINTER

(71) Applicant: Mitsubishi Electric Corporation, Tokyo (JP)

(72) Inventors: Yoshifumi Yamamoto, Tokyo (JP); Akihito Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/584,914

(22) Filed: Dec. 29, 2014

(65) Prior Publication Data

US 2015/0217580 A1 Aug. 6, 2015

(30) Foreign Application Priority Data

Feb. 3, 2014 (JP) ..... 2014-018180

(51) Int. Cl.

| | |
|---|---|
| ***B41J 11/00*** | (2006.01) |
| ***B41J 11/70*** | (2006.01) |
| ***B26D 1/24*** | (2006.01) |
| ***B41J 11/68*** | (2006.01) |
| ***B26D 5/06*** | (2006.01) |
| *B26D 1/00* | (2006.01) |

(52) U.S. Cl.

CPC ..... *B41J 11/70* (2013.01); *B26D 1/245* (2013.01); *B26D 5/06* (2013.01); *B41J 11/68* (2013.01); *B26D 2001/0066* (2013.01)

(58) Field of Classification Search

USPC ..... 347/220–222, 197–198, 171, 104; 400/621, 621.1, 633, 636; 83/162, 438

See application file for complete search history.

(56) References Cited

U.S. PATENT DOCUMENTS

| | | | | |
|---|---|---|---|---|
| 2006/0098071 | A1 | 5/2006 | Tanabe | |
| 2009/0074499 | A1 | 3/2009 | Suzuki et al. | |
| 2009/0195628 | A1 * | 8/2009 | Innes | 347/104 |
| 2013/0112055 | A1 * | 5/2013 | Lewalski et al. | 83/162 |

FOREIGN PATENT DOCUMENTS

| | | | |
|---|---|---|---|
| JP | 2000-229751 | A | 8/2000 |
| JP | 2002-002040 | A | 1/2002 |
| JP | 2007-111999 | A | 5/2007 |
| JP | 4951929 | B2 | 6/2012 |
| JP | 2013-014120 | A | 1/2013 |

* cited by examiner

*Primary Examiner* — Kristal Feggins

(74) *Attorney, Agent, or Firm* — Birch, Stewart, Kolasch & Birch, LLP

(57) ABSTRACT

A thermal transfer printer according to the present invention includes a printing section that thermally transfers an ink of an ink sheet to printing paper for performing printing and a slitter section that cuts, in a paper transport direction, the printing paper after the printing by the printing section. The printing section includes a thermal head and a platen roller pressed against the thermal head. The slitter section is capable of adjusting a cutting position for cutting the printing paper.

7 Claims, 7 Drawing Sheets

14

14

14A

THERMAL TRANSFER PRINTER

BACKGROUND OF THE INVENTION

1. Field of the Invention

The present invention relates to a thermal transfer printer, and more particularly, to a thermal transfer printer that cuts printing paper in a paper transport direction.

2. Description of the Background Art

Thermal transfer printers that draw printing paper from a paper roll for performing printing typically include cutters for cutting the printing paper after the printing in a direction orthogonal to a paper transport direction (namely, printing-paper width direction). Thermal transfer printers are also known that include slitters for cutting printing paper in parallel to a paper transport direction (for example, see Japanese Patent Application Laid-Open No. 2007-111999).

However, a position of the slitter is fixed in the thermal transfer printer disclosed in Japanese Patent Application Laid-Open No. 2007-111999, so that the thermal transfer printer fails to cut the printing paper in various paper widths.

SUMMARY OF THE INVENTION

It is an object of the present invention to provide a thermal transfer primer capable of cutting printing paper in various paper widths.

A thermal transfer printer according to the present invention includes a printing section that thermally transfers an ink of an ink sheet to printing paper for performing printing and a slitter section that cuts, in a paper transport direction, the printing paper after the printing by the printing section. The slitter section is capable of adjusting a cutting position for cutting the printing paper.

In the thermal transfer printer according to the present invention, the slitter section is capable of adjusting the cutting position for cutting the printing paper, so that the printing paper having the various paper widths can be output. The printing paper having the various paper widths can be output, thereby improving the convenience of the thermal transfer printer. Moreover, the printed matter having different paper widths can be obtained at a low cost without the need for providing the plurality of thermal transfer printers for every different paper width.

These and other objects, features, aspects and advantages of the present invention will become more apparent from the following detailed description of the present invention when taken in conjunction with the accompanying drawings.

DESCRIPTION OF THE PREFERRED EMBODIMENTS

<First Preferred Embodiment>

Figure 1:
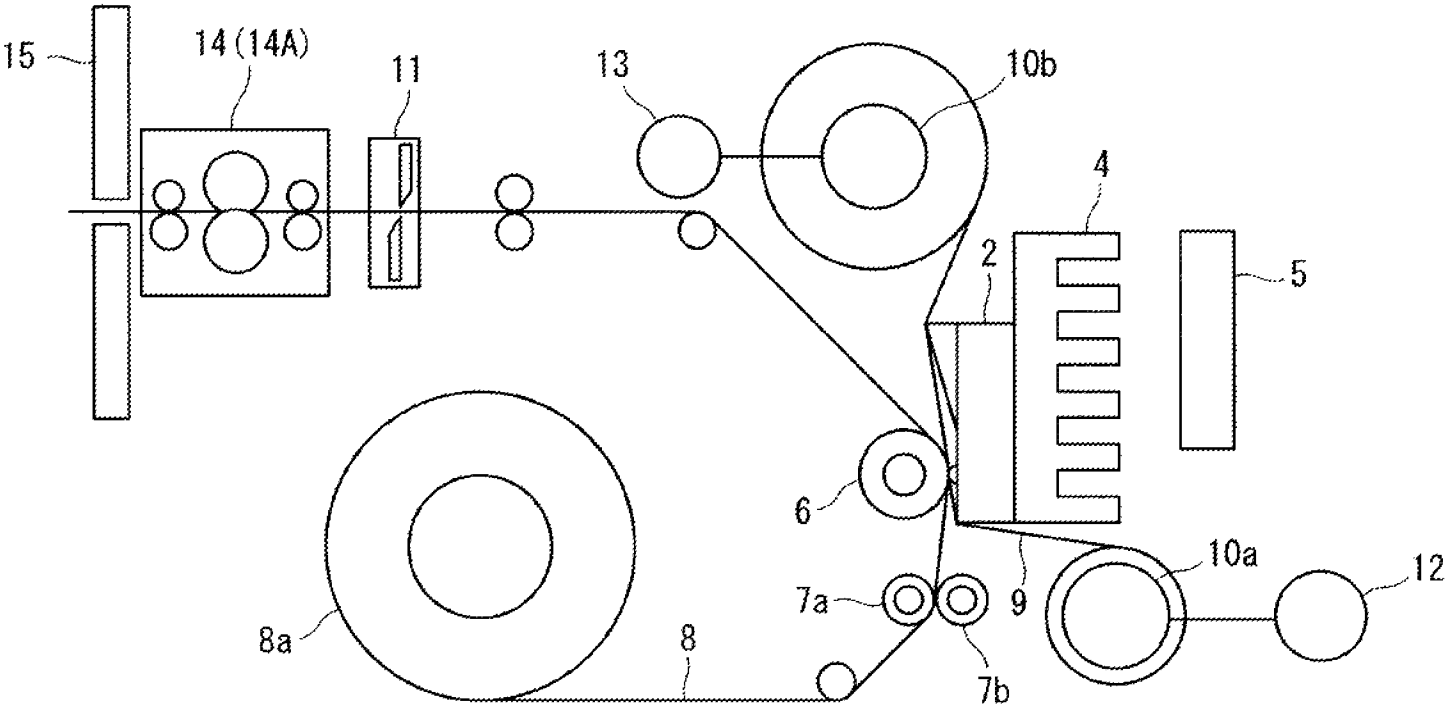
FIG. 1 is a diagram illustrating a configuration of a thermal transfer printer according to a first preferred embodiment.

FIG. 1 is a diagram illustrating a configuration of a thermal transfer printer according to this preferred embodiment. As shown in FIG. 1, the thermal transfer printer of the preferred embodiment includes, as a printing section for performing printing, a thermal head 2 that heats an ink sheet 9 and a platen roller 6 that presses a printing paper 8 against the ink sheet 9 between the thermal head 2 and the platen roller 6. A heat sink 4 that dissipates heat from the thermal head 2 is installed to the thermal head 2. A cooling fan 5 cools the heat sink 4.

The thermal transfer printer includes a grip roller 7*a* and a pinch roller 7*b* that draw the printing paper 8 from a printing paper roll 8 to transport the printing paper 8. The pinch roller 7*b* is pressed against the grip roller 7*a* via the priming paper 8. The ink sheet 9 is unwound from an ink unwinding reel 10*b*. The ink sheet 9 is wound around an ink winding reel 10*a* after being used for the printing. The ink sheet 9 has pigments of yellow (Y), magenta (M), and cyan (C) and an over coat layer (OP) arranged in the stated order therein.

The thermal transfer printer further includes a cutter section 11 that cuts the printing paper 8 in a paper width direction, a slitter section 14 that cuts the printing paper 8 in a paper transport direction, and a paper ejection opening 15.

In addition, FIG. 1 does not show a power supply portion, an image processor, a sensor, a drive portion, a controller, and a structure supporting portion, for example.

Next, printing operations of the thermal transfer printer will be described with reference to FIG. 1. Image data is transferred to the thermal transfer printer and is converted into print data for performing printing in the image processor (not shown). The thermal head 2 is pressed against the platen roller 6 via the ink sheet 9 and the printing paper 8 during the printing. The thermal head 2 applies a heating value corresponding to the print data to the ink sheet 9 and the printing paper 8, to thereby sublimate the pigments of the ink sheet 9 and transfer the pigments to the printing paper 8. The printing operations are repeated in order of, for example, Y, M, C, and OP on the printing screen of the printing paper 8 to form an image. The printing paper 8 sandwiched between the grip roller 7*a* and the pinch roller 7*b* is transported during the printing. A stepping motor (not shown) rotationally moves the grip roller 7*a* at a constant speed. An ink winding motor 12 winds the ink sheet 9 under a predetermined tension via the ink winding reel 10*a* during the printing. The ink unwinding reel 10*b* is also directly connected to a torque limiter 13 such that the ink sheet 9 is under the predetermined tension.

The grip roller 7*a* and the pinch roller 7*b* transport, to the cutter section 11, the printing paper 8 in which the printing operations have been repeated in order of Y, M, C, and OP to complete the formation of the printing image. When a predetermined length of margin of a tip of the printing paper 8 on which printing is not performed passes through the cutter section 11, a cutter included in the cutter section 11 cuts the tip of the printing paper 8 in the paper width direction. The grip roller 7*a* and the pinch roller 7*b* continuously transport the printing paper 8 in which the margin of the tip has been cut to the slitter section 14.

The printing paper 8 is cut in a direction parallel to the transport direction in the slitter section 14. The slitter section 14 will be described below. Furthermore, the cutter section 11 cuts a portion being a rear end of the printing paper 8. After being separated from the printing paper 8*a*, the printing paper 8 is ejected from the paper ejection opening 15.

<Detailed Description of Slitter Section>

Figure 2:
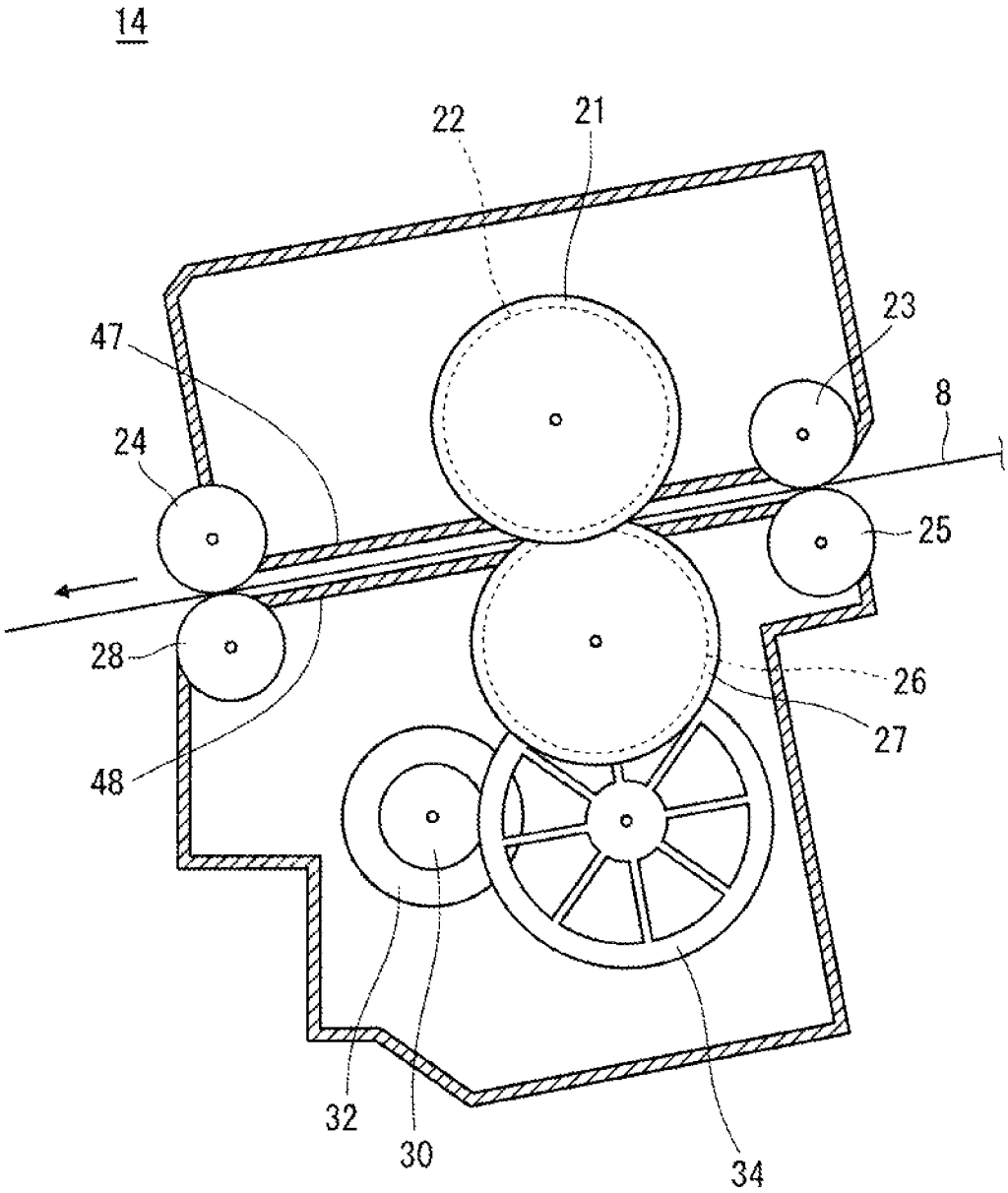
FIG. 2 is a cross-sectional view of a slitter section according to the first preferred embodiment.
Figure 3:
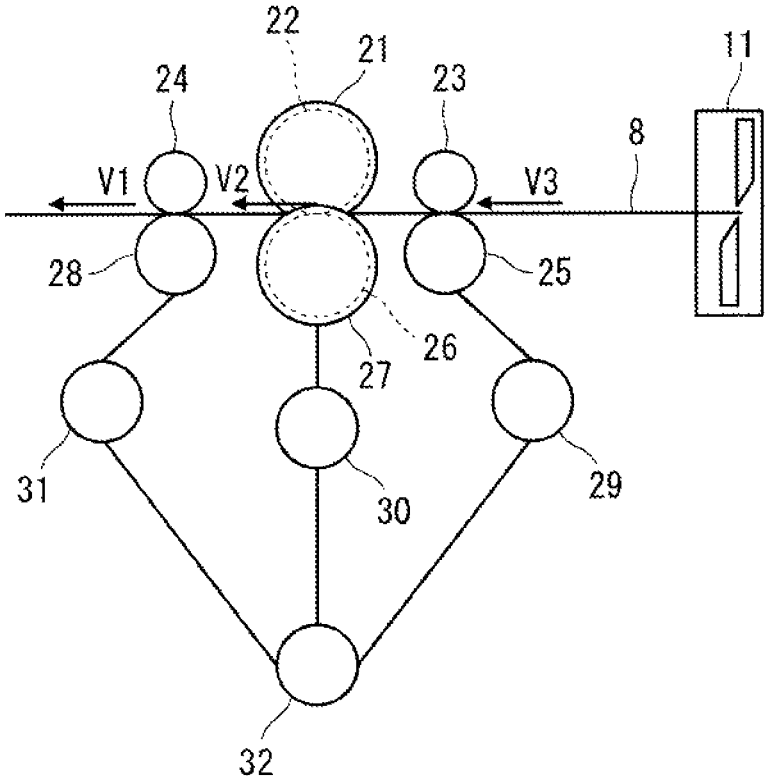
FIG. 3 is a diagram schematically illustrating a transport mechanism of the slitter section according to the first preferred embodiment.
Figure 4:
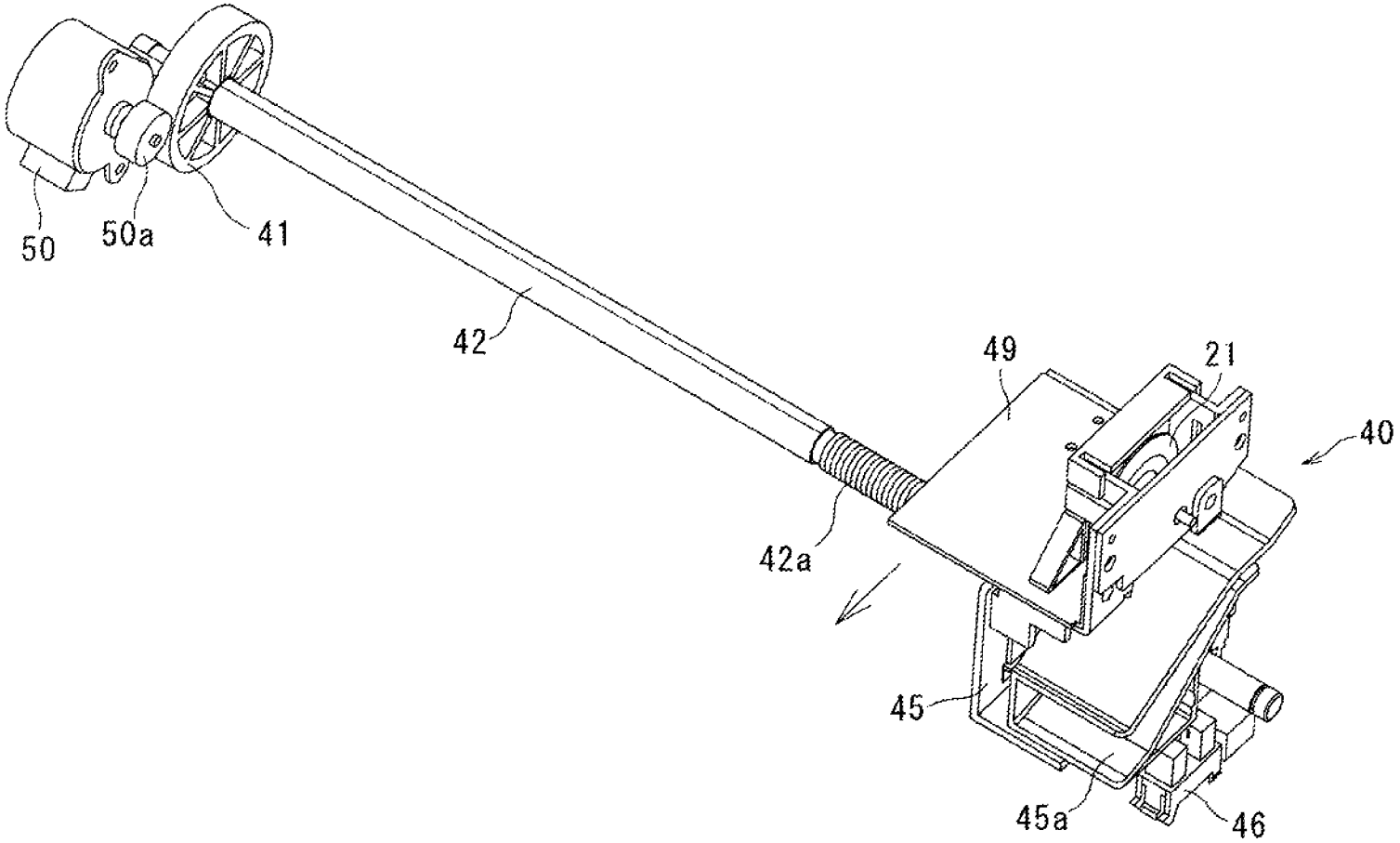
FIG. 4 is a perspective view of a cutting position adjustment mechanism of the slitter section according to the first preferred embodiment.
Figure 5:
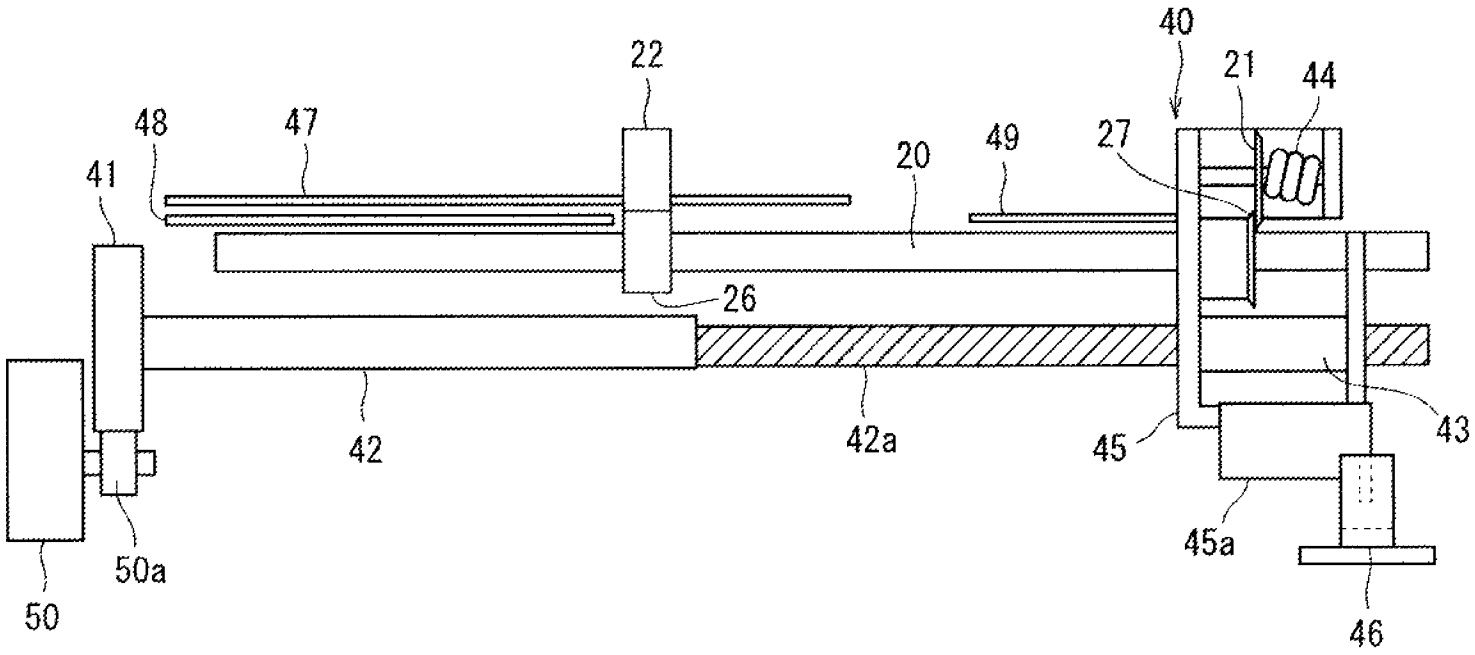
FIGS. 5 and 6 are front views of the slitter section according to the first preferred embodiment.
Figure 6:
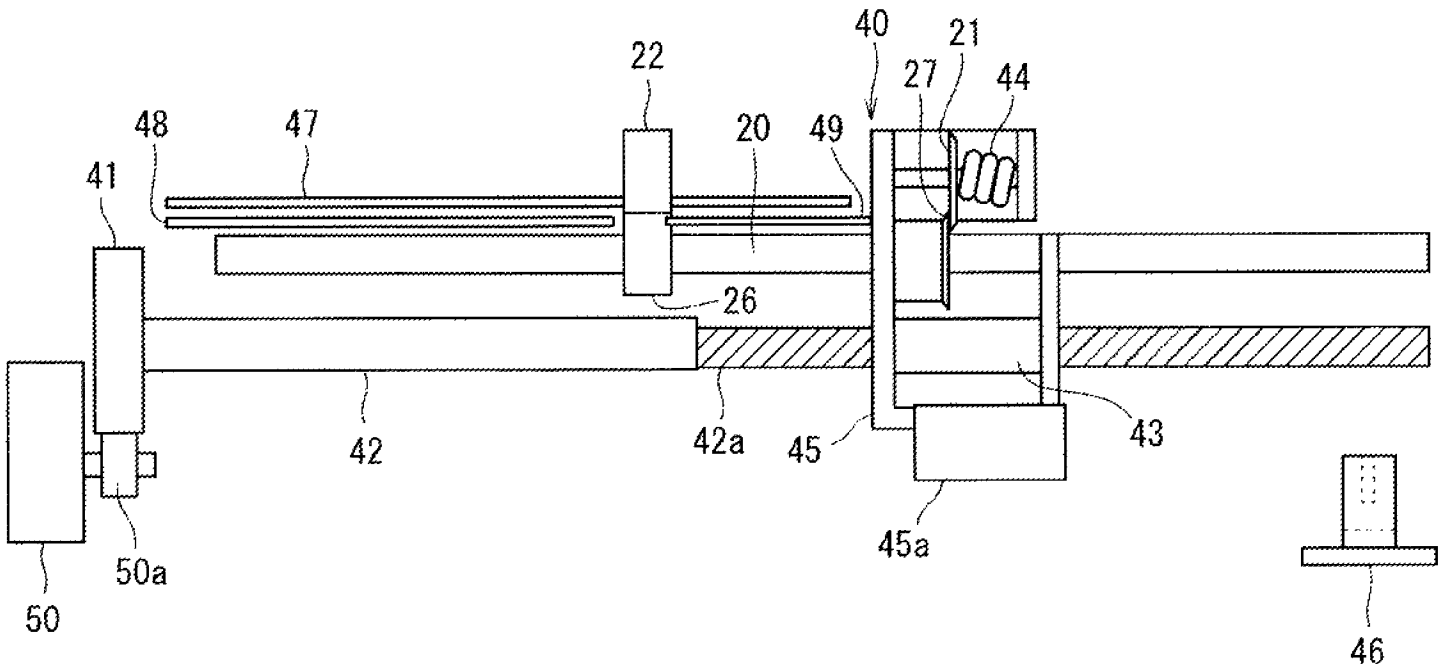

FIG. 2 is a cross-sectional view of the slitter section 14 of the thermal transfer printer according to the preferred embodiment. FIG. 3 is a diagram schematically illustrating a transport mechanism of the slitter section 14. FIG. 4 is a perspective view of a cutting position adjustment mechanism of the slitter section 14. FIGS. 5 and 6 are front views of the slitter section 14.

As shown in FIGS. 2 to 6, the slitter section 14 includes a driving-side circular blade 27 and a driven-side circular blade 21 disposed in a frame 40 (described below) that moves in the paper width direction. The driven-side circular blade 21 is rotated in conjunction with a rotary motion of the driving-side circular blade 27. The printing paper 8 passes between the driving-side circular blade 27 as a lower blade and the driven-side circular blade as an upper blade to be cut in the direction parallel to the transport direction. The slitter section 14 includes a slitter driving roller 26 and a pinch roller 22 that transport paper. The slitter driving roller 26 is fixed to the same shaft 20 to which the driving-side circular blade 27 is fixed. In other words, the slitter driving roller 26 and the driving-side circular blade 27 are rotated at the same speed. The pinch roller 22 is disposed on the same axis as that of the driven-side circular blade 21.

As shown in FIGS. 2 and 3, a slitter paper-feed roller 25 and the pinch roller 23 are provided on the cutter section 11 side (namely, opposite to the paper ejection opening 15) in the slitter section 14. The slitter paper-feed roller 25 transports paper to the slitter driving roller 26 side. The pinch roller 23 presses the printing paper 8 between the slitter paper-feed roller 25 and the pinch roller 23.

A slitter paper-ejection roller 28 and a pinch roller 24 are provided on the paper ejection opening 15 side. The slitter paper-ejection roller 28 transports paper to the paper ejection opening 15 side. The pinch roller 24 presses the printing paper 8 between the slitter paper-ejection roller 28 and the pinch roller 24. The slitter section 14 includes an upper paper guide 47 and a lower paper guide 48 as paper guides to the transport path.

The pinch roller 22, the pinch roller 23, and the pinch roller 24 are pressed down with screws (not shown) to apply appropriate pressure to the slitter driving roller 26, the slitter paper-feed roller 25, and the slitter paper-ejection roller 28, respectively.

Operations of the transport mechanism of the slitter section 14 will now be described. A common motor 32 rotationally moves the slitter driving roller 26 via a torque limiter 30 and a gear 34. The common motor 32 also rotationally moves the slitter paper-feed roller 25 and the slitter paper-ejection roller 28 via a torque limiter and a gear, which are not shown. At this time, the shaft 20 connects between the driving-side circular blade 27 and the slitter driving roller 26 that are rotated at the same rotational speed. The printing paper 8 guided to the slitter section 14 is sandwiched between the slitter paper-feed roller 25 and the pinch roller 23 to be transported and passes between the slitter driving roller 26 and the pinch roller 22. While being transported by the slitter driving roller 26 and the pinch roller 22, the printing paper 8 passes between the rotating driving-side circular blade 27 and the driven-side circular blade 21 to be cut in the transport direction. Then, the printing paper 8 sandwiched between the slitter paper-ejection roller 28 and the pinch roller 24 is transported and is ejected from the paper ejection opening 15.

A circumferential velocity of the slitter paper-ejection roller 28, a circumferential velocity of the slitter driving roller 26, and a circumferential velocity of the slitter paper-feed roller 25 are defined by V1, V2, and V3, respectively. In this preferred embodiment, the slitter paper-feed roller 25, the slitter driving roller 26, and the slitter paper-ejection roller 28 are rotationally moved such that V1 is greater than V2 that is greater than V3. In other words, a relationship of V1>V2>V3 holds true. Such relationship among the circumferential velocities of the rollers can suppress a wrinkle in the printing paper 8 during transport. This can improve the quality of cutting in the slitter section 14.

As shown in FIG. 3, a torque limiter 29, a torque limiter 30, a torque limiter 31, and a gear (not shown) that are appropriate are provided between the common motor 32 and each roller such that the above-mentioned relationship among the circumferential velocities of the rollers holds true.

Next, the position adjustment mechanism of the slitter section 14 will be described. As shown in FIGS. 4 to 6, the slitter section 14 includes a screw shaft 42, the frame 40 that moves along the screw shaft 42 in the paper width direction, and a pulse motor 50 that rotationally moves the screw shaft 42 via a gear 50*a* and a transmission gear 41. The frame 40 includes a paper guide 49, a circular blade frame 45 that holds the driving-side circular blade 27 and the driven-side circular blade 21, and a shaft connecting portion 43 that meshes with a screw portion 42*a* of the screw shaft 42 and is fixed to the circular blade frame 45.

The slitter section 14 includes a sensor 46, which will be described below. The frame 40 includes a sensor cover 45*a* that covers the sensor 46. The frame 40 includes a spring 44. The spring 44 applies pressure to the driven-side circular blade 21 to press the driven-side circular blade 21 against the driving-side circular blade 27.

Operations of the position adjustment mechanism of the slitter section 14 will be described below. The frame 40 moves in a rotational axis direction of the screw shaft 42 (namely, paper width direction) in conjunction with the rotation of the screw shaft 42. The frame 40 is on standby at a standby position shown in FIG. 6 in the initial state. Here, the standby position is a position at which the circular blades (driving-side circular blade 27 and driven-side circular blade 21) included in the frame 40 do not overlap the printing paper 8 in a plan view. While the frame 40 is on standby at the standby position, the sensor cover 45*a* covers the sensor 46. In other words, the controller (not shown) can determine whether the frame 40 is located at the standby position by the signal from the sensor 46.

The controller moves the frame 40 from the standby position to a position corresponding to a desirable paper width (position shown in FIG. 5, for example) before the tip of the printing paper 8 reaches the slitter section 14. In other words, with the frame 40 located at the standby position, the pulse motor 50 is driven by predetermined pulses to rotate the screw portion 42*a* of the screw shaft 42 by the predetermined amount of rotation, to thereby move the frame 40 from the standby position (FIG. 6) to the desirable cutting position (FIG. 5).

An amount of rotation of the pulse motor 50 can be accurately controlled by the number of pulses input to the pulse motor 50. In other words, the pulse motor 50 rotationally moves the screw shaft 42, allowing the position of the frame 40 to be accurately moved to any given position.

In a case where the printing paper 8 is not cut in the direction parallel to the paper transport direction, the frame 40 remains on standby at the standby position.

The screw portion 42*a* of the screw shaft 42 accounts for one-half the entire screw shaft 42, and the range of the screw portion 42*a* may be expanded. Expanding the range of the screw portion 42*a* of the screw shaft 42 expands the movable range of the frame 40, allowing for cutting at any given position in the entire paper width.

In this preferred embodiment, the pulse motor 50 is used for rotationally moving the screw shaft 42, but it is not limited to a pulse motor. A general motor and a sensor that determines the position of the frame 40 may be provided to control the position of the frame 40. In addition, a general motor and an encoder that determines a rotation of the motor may be provided to control the position of the frame 40.

After the slitter section 14 has cut the printing paper 8, the slitter section 14 may cut the printing paper 8 again by rewinding the printing paper 8 in the paper feed direction and changing the position of the frame 40. This allows for cutting at a plurality of positions. The driving-side circular blades 27 and the driven-side circular blades 21 in a plurality of pairs may be provided to cut the printing paper 8 at a plurality of positions at once.

<Effects>

The thermal transfer printer in the preferred embodiment includes the printing section that thermally transfers the ink of the ink sheet 9 to the printing paper 8 for performing printing and the slitter section 14 that cuts, in the paper transport direction, the printing paper 8 after the printing by the printing section. The slitter section 14 is capable of adjusting the cutting position for cutting the printing paper 8.

Therefore, the slitter section 14 is capable of adjusting the cutting position for cutting the printing paper 8, so that the printing paper 8 having the various paper widths can be output. The printing paper 8 having the various paper widths can be output, thereby improving the convenience of the thermal transfer printer. The thermal transfer printer can output the printing paper 8 having the various paper widths, and thus the printed matter having different paper widths can be obtained at a low cost without the need for providing the plurality of thermal transfer printers for every different paper width.

In the thermal transfer printer in the preferred embodiment, the slitter section 14 includes the screw shaft 42, the motor (namely, pulse motor 50) that rotationally moves the screw shaft 42, and the frame 40 that meshes with the screw portion 42*a* of the screw shaft 44 and moves in the rotational axis direction of the screw shaft 42 in conjunction with the rotary motion of the screw shaft 42. The frame 40 includes at least the one blade for cutting the printing paper 8. The rotational axis direction of the screw shaft 42 is the paper width direction orthogonal to the paper transport direction.

Therefore, the slitter section 14 has the configuration that combines the motor (namely, pulse motor 50), the screw shaft 42, and the frame 40 including at least the one blade, allowing the position of the frame 40 to be adjusted correspondingly to an amount of rotary motion of the motor. Thus, the slitter section 14 is capable of adjusting the cutting position for cutting the priming paper 8. The screw shaft 42 is used to move the position of the frame 40, achieving the space-saving position adjustment mechanism of the frame 40 at a low cost.

In the preferred embodiment, the motor (namely, pulse motor 50) is a pulse motor.

Therefore, the pulse motor 50 can accurately control an amount of rotation of the screw shaft 42, whereby the slitter section 14 is capable of adjusting the cutting position for cutting the printing paper 8 with high accuracy. This can suppress variations in width of the printing paper 8 output from the thermal transfer printer.

In the thermal transfer printer in the preferred embodiment, the slitter section 14 further includes a rotary encoder that determines the amount of rotation of the screw shaft 42.

Therefore, the thermal transfer printer further includes the rotary encoder that can determine the amount of rotation of the screw shaft 42, whereby the slitter section 14 is capable of adjusting the cutting position for cutting with high accuracy. This can suppress variations in width of the printing paper 8 output from the thermal transfer printer.

In the thermal transfer printer in the preferred embodiment, at least the one blade included in the frame 40 is on standby at the position at which at least the one blade does not overlap the printing paper 8 in the plan view when not cutting the printing paper 8.

Therefore, the printing paper 8 can be reliably prevented from unintentional damage caused by the blade included in the frame 40 in a case where the printing paper 8 is not cut in the slitter section 14. The printed surface can be prevented from damage, so that it is particularly effective for both-sided printing performed on the printing paper 8.

The thermal transfer printer in the preferred embodiment further includes: the slitter paper-feed roller 25 that feeds the printing paper 8 to the slitter section 14; the pinch roller 23 that presses the printing paper 8 between the slitter paper-feed roller 25 and the pinch roller 23; the slitter paper-ejection roller 28 that ejects the priming paper 8 from the slitter section 14; the pinch roller 24 that presses the printing paper 8 between the slitter paper-ejection roller 28 and the pinch roller 24; the slitter driving roller 26 that is disposed between the slitter paper-feed roller 25 and the slitter paper-ejection roller 28 and transports the printing paper 8; and the pinch roller 22 that presses the printing paper 8 between the slitter driving roller 26 and the pinch roller 22. At least the one blade included in the frame 40 includes the two circular blades disposed to face each other so as to sandwich the printing paper 8 therebetween. One of the two circular blades is the driving-side circular blade 27 that is rotationally moved at the same speed as that of the slitter driving roller 26 and the other blade is the driven-side circular blade 21 that is rotated by being pressed by the driving-side circular blade 27. The slitter paper-ejection roller 28 has the circumferential velocity greater than the circumferential velocity of the slitter driving roller 26. The slitter driving roller 26 has the circumferential velocity greater than the circumferential velocity of the slitter paper-feed roller 25.

Therefore, the slitter paper-ejection roller 28 has the circumferential velocity greater than that of the slitter driving roller 26 that has the circumferential velocity greater than that of the slitter paper-feed roller 25, whereby a wrinkle in the printing paper 8 being transported in the slitter section 14 can be suppressed. This can improve the quality of cutting in the slitter section 14.

<Second Preferred Embodiment>

Figure 7:
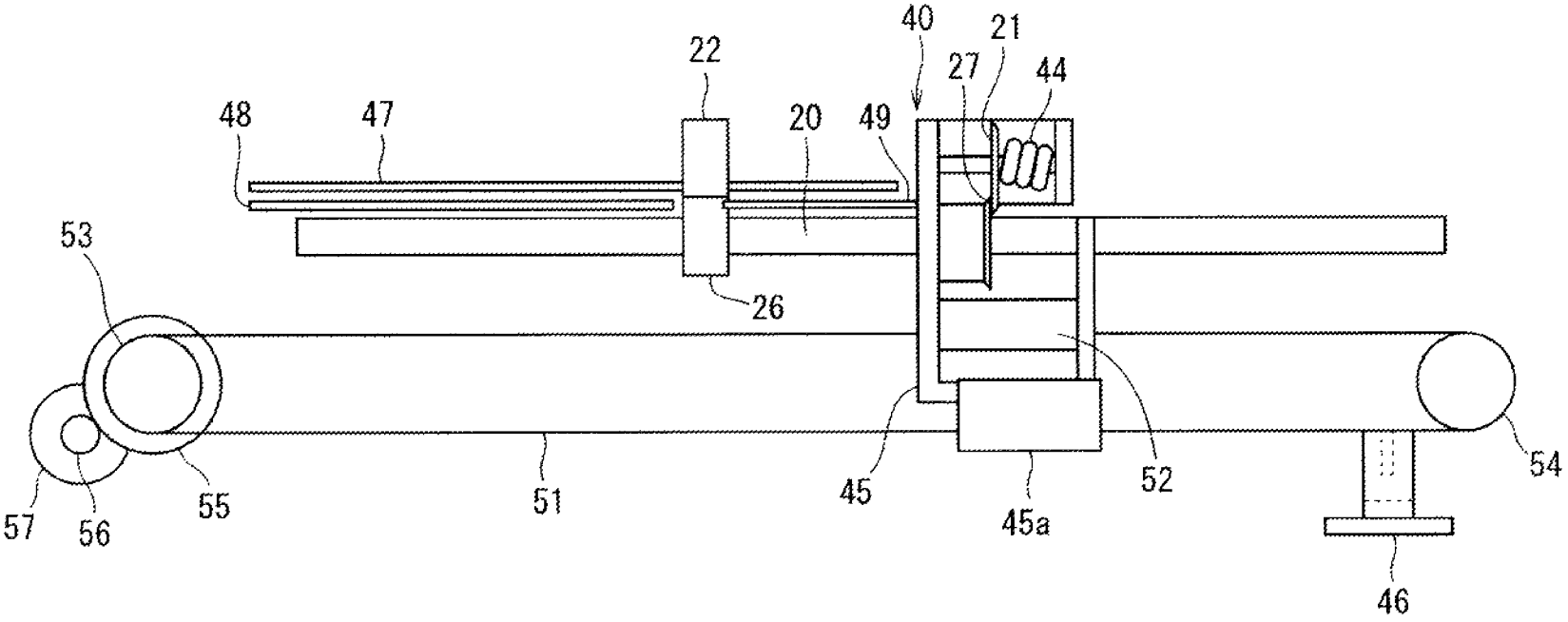
FIG. 7 is a front view of a slitter section according to a second preferred embodiment.

FIG. 7 is a front view of a slitter section 14A of a thermal transfer printer according to this preferred embodiment. The configuration except for the position adjustment mechanism of the slitter section 14A of the thermal transfer printer in the preferred embodiment is the same as the configuration of the slitter section 14 in the first preferred embodiment. Thus, description about the transport mechanism of the slitter section 14A of the thermal transfer printer in this preferred embodiment will be omitted. The same components as those described in the first preferred embodiment are denoted by the same references.

The slitter section 14A of the preferred embodiment includes a pair of a pulley 53 and a pulley 54, a belt 51 that loops over the pulley 53 and the pulley 54, the frame 40 that is fixed to the belt 51 and moves the transport direction (namely, paper width direction) of the belt 51, and a motor 57 that rotationally moves the pulley 53.

The slitter section 14A further includes a gear 55 and a relay gear 56 that transmits the power of the motor 57 to the pulley 53. The gear 55 includes a rotary encoder that determines an amount of rotation of the pulley 53.

The frame 40 is fixed to the belt 51 at a belt connecting portion 52. The frame 40 has the same configuration except for this as that of the first preferred embodiment, so that description will be omitted. Similarly to the first preferred embodiment, the slitter section 14A includes the sensor 46.

Operations of the position adjustment mechanism of the slitter section 14A will now be described. The frame 40 moves in the transport direction (namely, paper width direction) of the belt 51 in conjunction with the rotation of the pulley 53. The frame 40 is on standby at a standby position in the initial state. Here, the standby position is a position at which the circular blades (driving-side circular blade 27 and driven-side circular blade 21) included in the frame 40 do not overlap the printing paper 8 in a plan view. While the frame 40 is on standby at the standby position, the sensor cover 45*a* covers the sensor 46. In other words, the controller (not shown) can determine whether the frame 40 is located at the standby position by the signal from the sensor 46.

The controller moves the frame 40 from the standby position to a position corresponding to a desirable paper width (position shown in FIG. 7, for example) before the tip of the printing paper 8 reaches the slitter section 14A. In other words, with the frame 40 located at the standby position, the motor 57 is driven until the rotary encoder that determines the amount of rotation of the pulley 53 determines the predetermined amount of rotation, to thereby move the frame 40 from the standby position (FIG. 6) to the desirable cutting position (FIG. 5).

The rotary encoder determines the amount of rotation of the pulley 53, allowing the position of the frame 40 to be accurately controlled. In other words, the position of the frame 40 can be accurately moved to any given position.

In a case where the printing paper 8 is not cut in the direction parallel to the paper transport direction, the frame 40 remains on standby at the standby position.

<Effects>

The slitter section 14A included in the thermal transfer printer in the preferred embodiment includes: the pair of pulleys (pulleys 53, 54); the belt 51 that loops over the pair of pulleys; the motor 57 that rotationally moves the pair of pulleys; the frame 40 fixed to the belt 51; and the rotary encoder that determines the amount of rotation of the pair of pulleys. The frame 40 includes at least the one blade for cutting the printing paper 8. The transport direction of the belt 51 is the paper width direction orthogonal to the paper transport direction.

Therefore, the slitter section 14A has the configuration that combines the motor 57, the belt 51 that loops over the pair of pulleys, and the frame 40 including at least the one blade, allowing the position of the frame 40 to be adjusted correspondingly to the amount of rotary motion of the motor 57. Thus, the slitter section 14A is capable of adjusting the cutting position for cutting the printing paper 8. The pair of pulleys and the belt 51 are used to move the position of the frame 40, achieving the space-saving position adjustment mechanism of the frame 40 at a low cost. Furthermore, the slitter section 14A includes the rotary encoder (built in the gear 55) that determines the amount of rotation of the pulley 53, allowing the position of the frame 40 to be accurately controlled. In other words, the frame 40 can be accurately moved to any given position. This can suppress variations in width of the printing paper 8 output from the thermal transfer printer.

In addition, according to the present invention, the above preferred embodiments can be arbitrarily combined, or each preferred embodiment can be appropriately varied or omitted within the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. A thermal transfer printer, comprising:

a printing section that thermally transfers an ink of an ink sheet to printing paper for performing printing; and a slitter section that cuts, in a paper transport direction, said printing paper after the printing by said printing section, wherein said slitter section includes two circular blades disposed to face each other so as to sandwich said printing paper for cutting said printing paper, and said slitter section is capable of adjusting a cutting position for cutting said printing paper, and said thermal transfer printer further comprises:

a slitter paper-feed roller that feeds said printing paper to said slitter section;

a pinch roller that presses said printing paper between said slitter paper-feed roller and said pinch roller;

a slitter paper-ejection roller that ejects said printing paper from said slitter section;

a pinch roller that presses said printing paper between said slitter paper-ejection roller and said pinch roller;

a slitter driving roller that is disposed between said slitter paper-feed roller and said slitter paper-ejection roller and transports said printing paper; and a pinch roller that presses said printing paper between said slitter driving roller and said pinch roller, wherein one of said two circular blades is a driving-side circular blade that is rotationally moved at the same speed as that of said slitter driving roller and the other circular blade is a driven-side circular blade that is rotated by being pressed by said driving-side circular blade, said slitter paper-ejection roller has a circumferential velocity greater than a circumferential velocity of said slitter driving roller, and said slitter driving roller has a circumferential velocity greater than a circumferential velocity of said slitter paper-feed roller.

2. The thermal transfer printer according to claim 1, wherein said slitter section comprises:

a screw shaft;

a motor that rotationally moves said screw shaft; and a frame that meshes with a screw portion of said screw shaft and moves in a rotational axis direction of said screw shaft in conjunction with the rotary motion of said screw shaft, said frame includes said two circular blades, and the rotational axis direction of said screw shaft is a paper width direction orthogonal to the paper transport direction.

3. The thermal transfer printer according to claim 2, wherein said motor is a pulse motor.

4. The thermal transfer printer according to claim 2, wherein said slitter section further comprises a rotary encoder that determines the amount of rotation of said screw shaft.

5. The thermal transfer printer according to claim 2, wherein at least one of the circular blades included in said frame is on standby at a position at which said at least one blade does not overlap said printing paper in a plan view when not cutting said printing paper.

6. The thermal transfer printer according to claim 1, wherein said slitter section comprises:

a pair of pulleys;

a belt that loops over said pair of pulleys;

a motor that rotationally moves said pair of pulleys;

a frame fixed to said belt; and a rotary encoder that determines an amount of rotation of said pair of pulleys.

said frame includes said two circular blades, and a transport direction of said belt is a paper width direction orthogonal to the paper transport direction.

7. The thermal transfer printer according to claim 6, wherein at least one of the circular blades included in said frame is on standby at a position at which said at least one blade does not overlap said printing paper in a plan view when not cutting said printing paper.

* * * * *